United States Patent [19]

Bakewell et al.

[11] 4,374,719

[45] Feb. 22, 1983

[54] SYSTEM FOR ELECTROLYTIC CLEANING OF METAL WIRE IN LOOP FORM

[75] Inventors: Frank W. Bakewell, Washington Township, Westmoreland County; Charles D. Stricker, Monroeville Borough, both of Pa.

[73] Assignee: United States Steel Corporation, Pittsburgh, Pa.

[21] Appl. No.: 359,729

[22] Filed: Mar. 19, 1982

[51] Int. Cl.[3] ..... C25D 17/00

[52] U.S. Cl. ..... 204/202; 204/206

[58] Field of Search ..... 204/198, 202–206, 204/211

[56] References Cited

U.S. PATENT DOCUMENTS

| | | | |
|---|---|---|---|
| 1,065,090 | 6/1913 | Werth | 204/206 |
| 1,242,695 | 10/1917 | Hood | 204/24 |
| 1,515,092 | 11/1924 | Cowper-Coles | 204/28 |
| 2,165,326 | 7/1939 | Yerger et al. | 204/211 |
| 2,174,722 | 10/1939 | Herrmann | 204/145 R |
| 2,197,653 | 4/1940 | Wilson | 204/145 R |
| 2,264,857 | 12/1941 | Ranney | 204/206 |
| 2,271,736 | 2/1942 | Hall | 204/206 |
| 2,307,928 | 1/1943 | Hogaboom | 204/144.5 |
| 2,372,599 | 3/1945 | Nachtman | 204/144.5 |
| 2,495,695 | 1/1950 | Camin et al. | 204/206 |
| 2,535,966 | 12/1950 | Teplitz | 204/206 |
| 2,680,710 | 6/1954 | Kenmore et al. | 204/28 |
| 2,695,269 | 11/1954 | De Witz et al. | 204/28 |
| 2,909,474 | 10/1959 | Smith | 204/145 R |
| 3,002,537 | 10/1961 | Kenmore et al. | 204/28 |
| 3,320,101 | 5/1967 | McLean et al. | 148/36 |
| 3,338,809 | 8/1967 | Stricker | 204/144.5 |
| 3,399,702 | 9/1968 | Kenmore | 204/144.5 |
| 3,507,767 | 4/1970 | Stricker | 204/208 |
| 3,814,675 | 6/1974 | Sallo et al. | 204/145 R |
| 3,994,786 | 11/1976 | Marks et al. | 204/28 |
| 4,046,599 | 9/1977 | Economopoulos . | |
| 4,183,799 | 1/1980 | Sellitto et al. . | |

*Primary Examiner*—T. M. Tufariello

*Attorney, Agent, or Firm*—William F. Riesmeyer, III

[57] ABSTRACT

A system is provided for the electrolytic cleaning of metal wire which is arranged generally in horizontal, overlapped non-concentric loop form. The system includes a container for holding an electrolyte, means for conveying the wire in loop form through the electrolyte, and a plurality of tandem electrodes of opposite polarity separated by non-conductive barriers. The elongated electrodes include a wrap-around portion at each of their opposite ends. Each wrap-around portion provides from 5 to 35 percent additional electrode area which enables more effective cleaning to be accomplished adjacent the outer edges of the wire loops.

5 Claims, 3 Drawing Figures

SYSTEM FOR ELECTROLYTIC CLEANING OF METAL WIRE IN LOOP FORM

BACKGROUND OF THE INVENTION

This invention relates to apparatus for the electrolytic cleaning of wire which is arranged in overlapped, non-concentric loops of about the same diameter.

It is known to clean steel wire in straight-line form by passing it through acid or alkaline electrolyte solutions, while subjecting it to high current densities. Examples of such processes and apparatus therefor are disclosed in U.S. Pat. No. 3,338,809 and U.S. Pat. No. 3,507,767, respectively, both by the same applicant as herein. So far as applicant is aware, it has not been previously suggested to clean wire electrically where the wire is arranged in "Loopro" form.

Initial attempts to electropickle wire arranged in this form were not successful. The outer edges of the loops in the transverse direction consistently had a black, smutty-like appearing residue left on them. Analysis of this residue indicated it was composed of amorphous carbon, believed to be caused by preferential electrolytic attack. From work described in the above-mentioned patents, several factors such as solution temperature, electrode-to-wire spacing, and current density were known to influence preferential attack. However, none of these factors would explain the presence of residue only at the outer edges of the loops.

It is of course known that wire arranged in "Loopro" form contains greater mass at the outer edges of the loops due to its overlapped configuration. Thus, U.S. Pat. No. 3,320,101 McLean, suggests the need for proportionately greater cooling of these areas in a controlled cooling process of wire in "Loopro" form. Therefore, tests were initiated by the applicant to determine what factors may cause less effective cleaning of these outer loop areas.

Tests were carried out on straight wire in a pilot cell, varying several process parameters such as electrolyte temperature, current density, electrode-to-wire spacing, and various electrode configurations. While electrolyte temperature and current density again were confirmed to be significant factors, it was also indicated that electrode width and areas seemed to have an influence on cleaning effectiveness. The tests indicated that low effective electrode-to-wire surface area ratios were undesirable under certain process conditions in that a black residue was left on the wire, similar in appearance to that found in our tests of cleaning wire in the "Loopro" form. This represented a new finding in that the influence of electrode area on leaving residue after cleaning had not been suspected.

Previous work did show that certain minimum effective electrode-to-wire area ratios were necessary to maintain applied voltage requirements at reasonable levels, while still achieving the desired high-current density. Therefore, calculations were made of the electrode-to-wire surface area ratios at intervals across the wire loops. It was indicated that where flat electrodes are used, the ratio varies from 3:1 at the center of the loop to less than 0.67:1 at the outer loop edges. It will be apparent that even if top and bottom flat electrodes were used, a ratio of 3:1 at the outer loop edges could still not be achieved. However, various means were tried for increasing electrode-to-wire surface areas. For example, tests were carried out in the pilot cell using ribbed electrodes, i.e., a flat plate having a central raised rib for increasing electrode area. These tests did not prove successful in eliminating the black residue found on the wire in simulations of conditions similar to processing wire in loop form. While not wishing to be bound by theory, it now appears that it is not mere electrode area which is important, but rather the area of electrolyte between the electrode and wire which is available for conducting current therebetween.

It is therefore the primary object of this invention to provide a system for the electrolytic cleaning of wire, by either acid or alkaline processes, where the wire is arranged in generally horizontal, overlapped, non-concentric loop form.

SUMMARY OF THE INVENTION

According to this invention, a system is provided for electrolytically cleaning wire which is arranged in generally horizontal, overlapped, non-concentric loops, all of about the same diameter. Generally, the loops are formed from a single very long wire which is laid in overlapped coil form on a conveyor. Devices for creating such loops are well known. This invention is applicable as well to treating separate coils laid in overlapped fashion, as distinguished from those formed from a single length of wire as above-mentioned. For purposes of the specification and claims herein, the term wire refers to wire or rod of any diameter and includes coils formed from a single wire of any shape cross-section, as well as multiple wires of any shape cross-section twisted in what is known as strand or rope form. Moreover, the apparatus of this invention will provide effective cleaning of wire in loop form in either acid or electrolyte solutions as will be described hereafter.

The apparatus includes a container for holding an electrolyte. Containers for this purpose are well-known, and the details of their construction forms no part of the present invention. The device also includes means for conveying the wire in loop form on a generally horizontal passline through the electrolyte. An example of such means would be endless belt conveyors for bearing against top and bottom surfaces of the loops. The belts could have v-shaped longitudinal ribs for minimizing their area of contact with the wire. The conveying means may take on various other forms, such as rollers or other clamping device, the main criterion being that such means serves to maintain the proper electrode-to-wire spacing which is between 0.5 to about 2.0 inches.

The apparatus includes a plurality of elongated electrodes mounted in the container so as to extend lengthwise in generally transverse relation with respect to the passline. The electrodes are arranged in tandem in the passline direction and connected to an electric power supply (preferably direct current is used), such that adjacent ones of them are of opposite polarity. A plurality of non- conductive barriers are provided for separating each of adjacent pairs of the electrodes. The electrodes include a generally flat planar first portion extending fully across the loops on one side thereof. They also have a pair of second or wrap-around portions each joined to opposed narrow ends of the elongated first portion. Each wrap-around portion comprises at least a generally vertical leg extending along the outer edge of the wire loops. These wrap-around second portions are each designed to provide an additional electrode area facing the loops of from 5 to 35 percent of the area of the first electrode portion. This additional electrode area should be provided in a region extending from the vertical leg to a point one-sixth of the distance from the outer edge of the loops inwardly and thereacross. Preferably, the second electrode portions also include a horizontal leg extending from the vertical leg parallel to the first electrode portion inwardly toward the center of the loops. It is also desirable to contour the electrodes to provide closer wire-to-electrode spacings in the outer loop segments or where the wire surface area is largest. All wire spacings, however, should be maintained within the 0.5 to 2.0 inch spacing range.

DESCRIPTION OF THE PREFERRED EMBODIMENT

The apparatus of this invention is designed to permit surface conditioning of metal (especially steel) wires in the "Loopro" configuration by electrolytic cleaning or pickling techniques. It is most specifically designed for removal of scale and/or oxides and residual carbonaceous films formed during heat treating and the residual carbonaceous film that is left on higher carbon steel wires as the result of acid pickling. The apparatus may also be applied to removal of drawing lubricants by using an alkaline rather than an acid electrolyte.

Certain processing variables are important for obtaining good results as disclosed in U.S. Pat. No. 3,507,767 and U.S. Pat. No. 3,814,675, for electropickling, and in U.S. Pat. No. 3,668,090 for electroalkaline cleaning, the specifications of all three patents being incorporated by reference herein. Briefly for electropickling, an electrolyte containing from about 15 to 25 percent by weight sulfuric acid should be used. For treating 0.35% or higher carbon steel wire in "Loopro" form, it has been found best to maintain an electrolyte temperature below 90° F. As in straight-line wire processing, a minimum operating wire surface area current density of 40 amps/in.$^2$ is required. Similarly, for electroalkaline cleaning an electrolyte containing a 5 to 10 percent aqueous solution with chemical additions containing 60 to 80 percent NaOH, 5 to 30 percent $Na_4P_2O_7$ and 5 to 25 percent $Na_2CO_3$ should be used. The electrolyte should be kept at temperatures between 160° to 210° F. The current density should be between 30 to 50 amp/in.$^2$ for electroalkaline cleaning.

Figure 1:
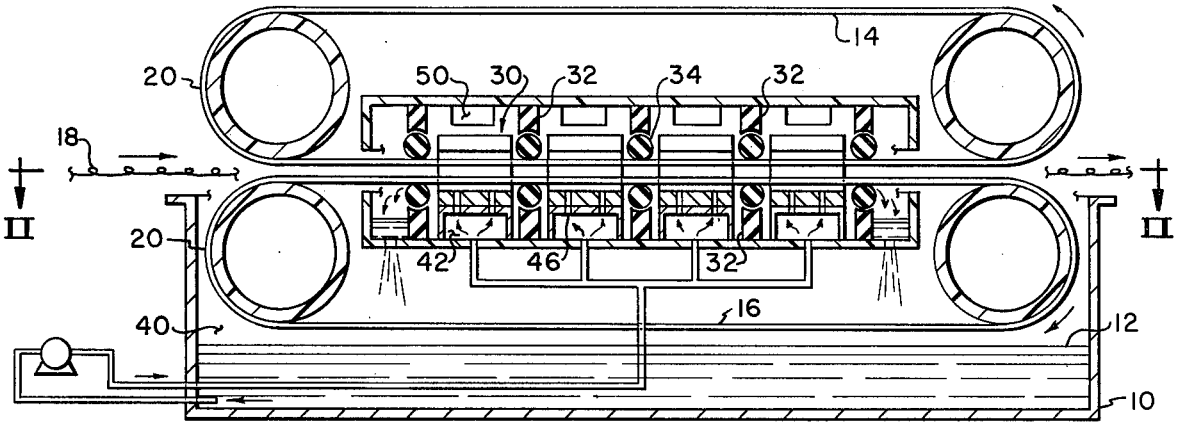
FIG. 1 is a schematic illustration of a side elevation view of the apparatus of this invention.
Figure 2:
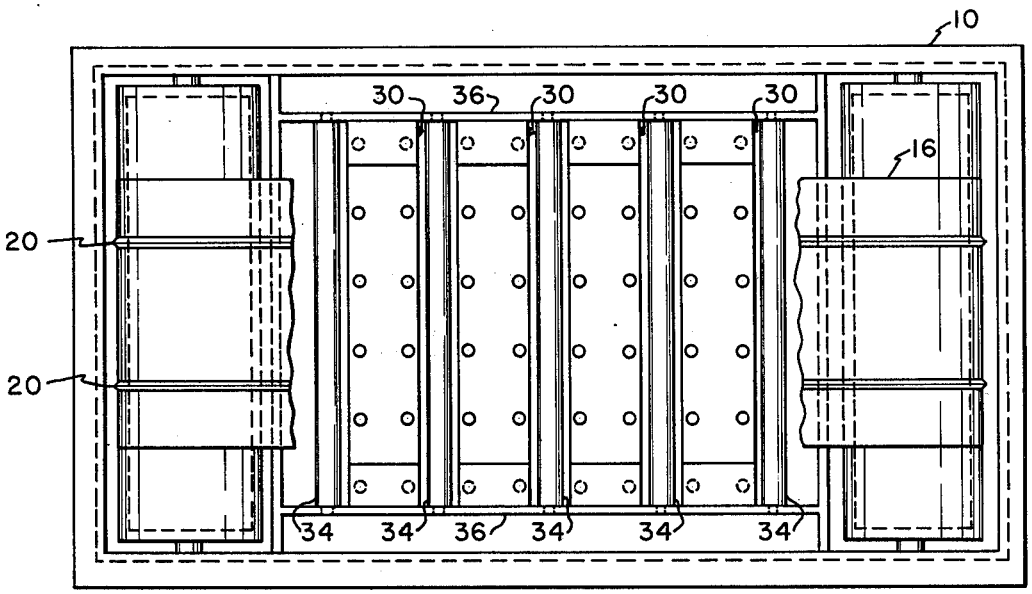
FIG. 2 is a plan view of the apparatus of FIG. 1.
Figure 3:
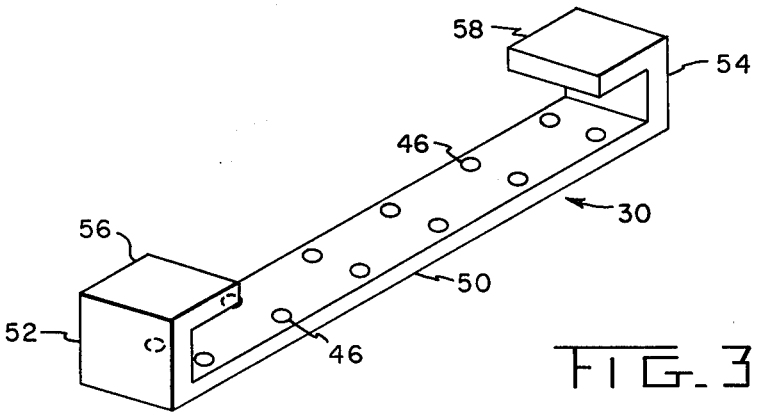
FIG. 3 is an isometric view of one of the electrodes of the type used according to the present invention.

The apparatus of this invention which is useful in the above-mentioned processes for treating wire in "Loopro" form, is illustrated in FIGS. 1, 2, and 3. The cell consists of a conventional container 10 holding an electrolyte 12. A pair of endless belt conveyors 14, 16 are provided for conveying rod or wire arranged in loop form 18 through the device. The belts preferably have lengthwise v-shaped ribs 20 bearing against the wire. A plurality of narrow wrap-around type electrodes 30 are positioned in the container in tandem in the direction of the passline of the wire. The electrodes are separated electrically by a plurality of narrow non-conductive barriers 32. Non-conductive rolls 34 may also be provided, for example, journalled in the barriers and support means 36 (FIG. 2) as shown in the drawings. The electrolyte is pumped from a reservoir 40 to chambers 42 below each electrode where it flows through ports 46 in each electrode and then is returned to the reservoir by means of overflow weirs 50. The electrodes 30 preferably are of lead, but other materials known in the art may be used. Each includes a first portion generally indicated at 50, vertical legs 52, 54 and short horizontal legs 56, 58. It should be noted that each vertical and horizontal leg combination is designed to provide from 5 to 35% electrode area in addition to that of the first portion 50. The amount of additional area required will be in proportion to the amount of wire surface area conveyed through the electrode region per unit time. For widely spaced loops of thick wire, perhaps only a vertical leg would be required. Also, the shape of both of the vertical and horizontal legs may vary, but it is important that additional electrode area of the above-mentioned range be provided in the region from the vertical leg inwardly about one-sixth (1/6) of the distance across the loops. Additional area may be provided further inward on the loops, but tends to decrease the current density concentration in the outer loop areas and this is undesirable.

We claim:

1. A system for electrolytically cleaning metal wire, said system comprising:

a container for holding an electrolyte, means for conveying the wire through the electrolyte on a generally horizontal passline, the wire being arranged in overlapped, non-concentric loops of about the same diameter lying flat in the passline direction, a plurality of elongated electrodes mounted in the container so as to extend lengthwise in generally transverse relation with respect to the passline, said electrodes being arranged in tandem in the passline direction and being adapted to be connected to a supply of electric current such that adjacent ones thereof are of opposite polarity, and a plurality of non-conductive barriers for electrically separating each adjacent pair of said electrodes, said electrodes including a planar first portion extending lengthwise fully across said loops on one side thereof and a pair of wrap-around second portions joined to each of the opposed narrow ends of the first portion, said wrap-around second portions each including at least a generally vertical leg extending along the outer edges of the wire loops, said second portions each providing an additional electrode area, within the outer one-sixth (1/6) of the loops as measured in a transverse direction normal to the passline, of from 5 to 35 percent of the area of said first electrode portion, the first and second electrode portions providing an electrode-to-wire spacing within the range of about 0.5 to about 2.0 inches, whereby, the wire loops are more effectively cleaned at the outer edges thereof.

2. The system of claim 1 wherein each of said second electrode portions include a horizontal leg extending from the vertical leg partially inward toward the center of the loops parallel to said first electrode portion.

3. The system of claim 1 wherein the width of said electrodes is not more than three (3) inches and the thickness of said barriers is within the range of 0.25 to 0.50 inches.

4. The system of claim 1 wherein the additional area provided by each of said second electrode portions is within the range of 15 to 25 percent.

5. The system of claim 1 wherein said electrodes are contoured so that the wire-to-electrode spacing is smallest in the regions of high wire surface areas and largest in the regions of low wire surface areas.

* * * * *